United States Patent [19]

Kapich

[11] Patent Number: 4,764,088

[45] Date of Patent: Aug. 16, 1988

[54] INLET GUIDE VANE ASSEMBLY

[76] Inventor: Davorin D. Kapich, 3111 Serrand Dr., Carlsbad, Calif. 92009

[21] Appl. No.: 40,858

[22] Filed: Apr. 21, 1987

[51] Int. Cl.[4] ..... F04D 29/36

[52] U.S. Cl. ..... 415/150; 415/29; 415/49; 415/148; 415/156

[58] Field of Search ..... 415/26, 29, 42, 48, 415/49, 146, 147, 148, 149 R, 150, 151, 156, 157

[56] References Cited

U.S. PATENT DOCUMENTS

| | | | |
|---|---|---|---|
| 2,814,431 | 11/1957 | Darrow et al. | 415/158 |
| 3,204,863 | 9/1965 | Hausammann | 415/150 |
| 4,029,433 | 6/1977 | Penny et al. | 415/156 |
| 4,214,850 | 7/1980 | Sato | 415/49 |
| 4,324,526 | 4/1982 | Berchtold et al. | 415/158 |
| 4,470,256 | 9/1984 | Palmer | 415/159 |
| 4,657,481 | 4/1987 | Mowill et al. | 415/151 |

*Primary Examiner*—Robert E. Garrett
*Assistant Examiner*—John T. Kwon
*Attorney, Agent, or Firm*—John R. Ross, Jr.

[57] ABSTRACT

An inlet guide vane assembly for a pump or a compressor having rotary blades. The guide vanes are pivotably disposed so that a portion of the vanes can be inserted into or withdrawn from the inlet passageway of the pump or the compressor by pivoting the guide vanes about a pivot axes. A control is provided for controlling the degree of pivot.

10 Claims, 4 Drawing Sheets

FIG. 8
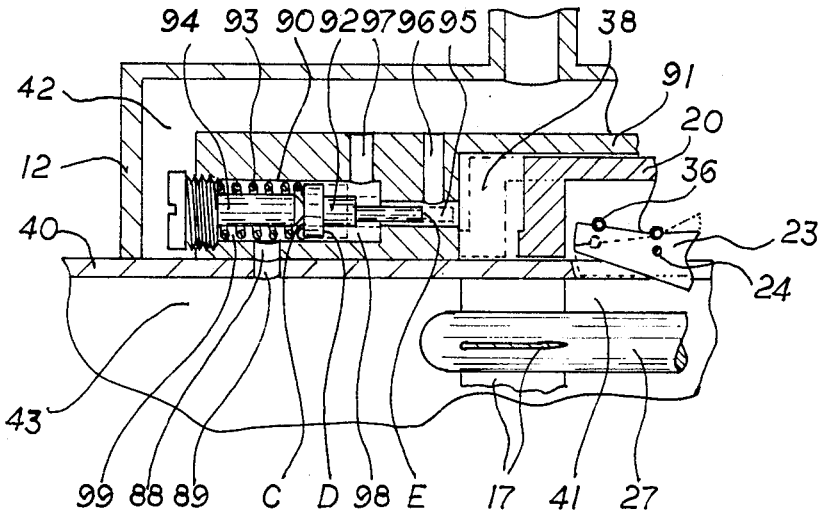
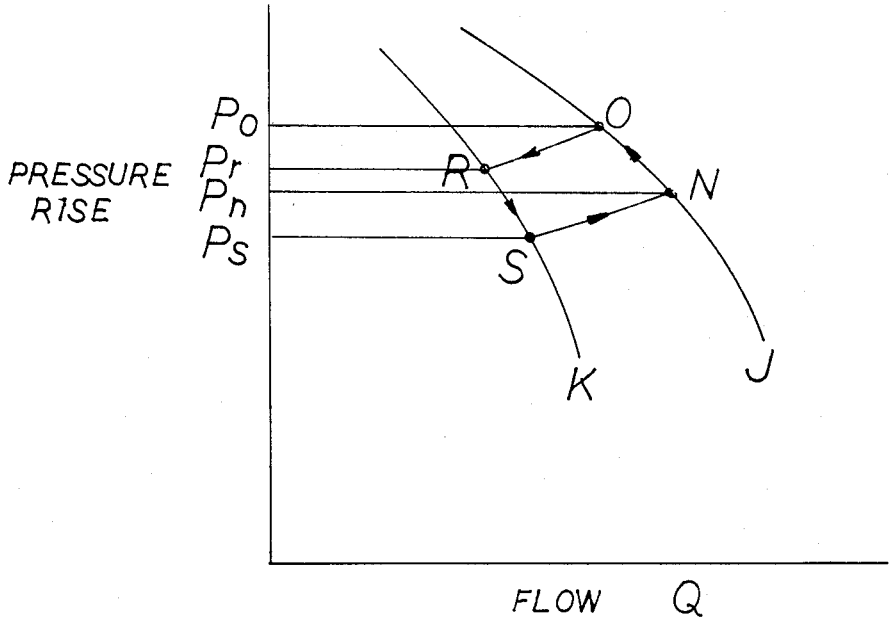
FIG. 9

FIG. 10
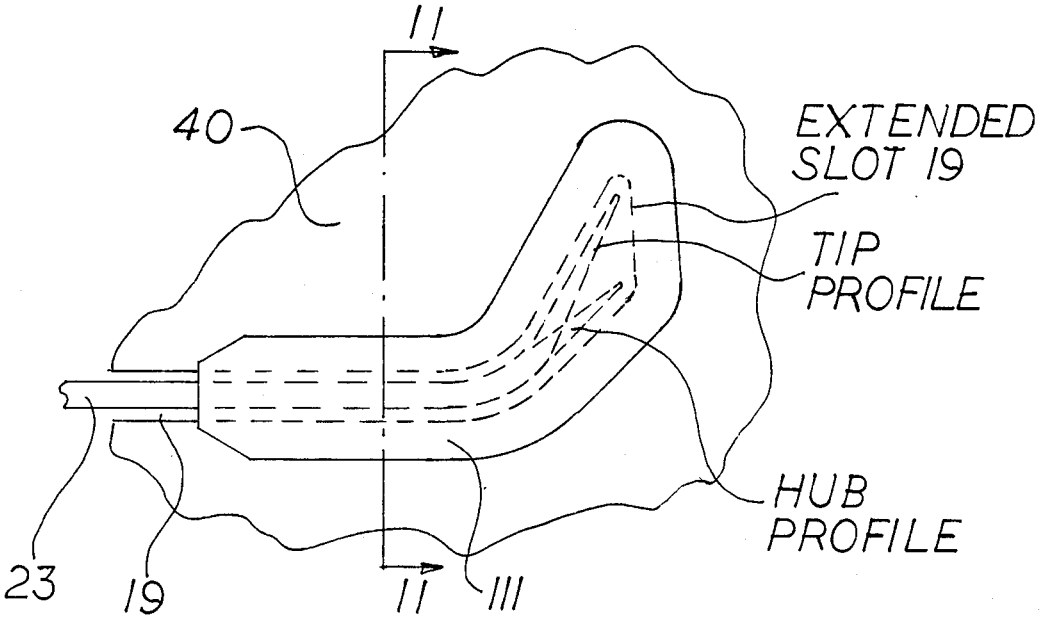
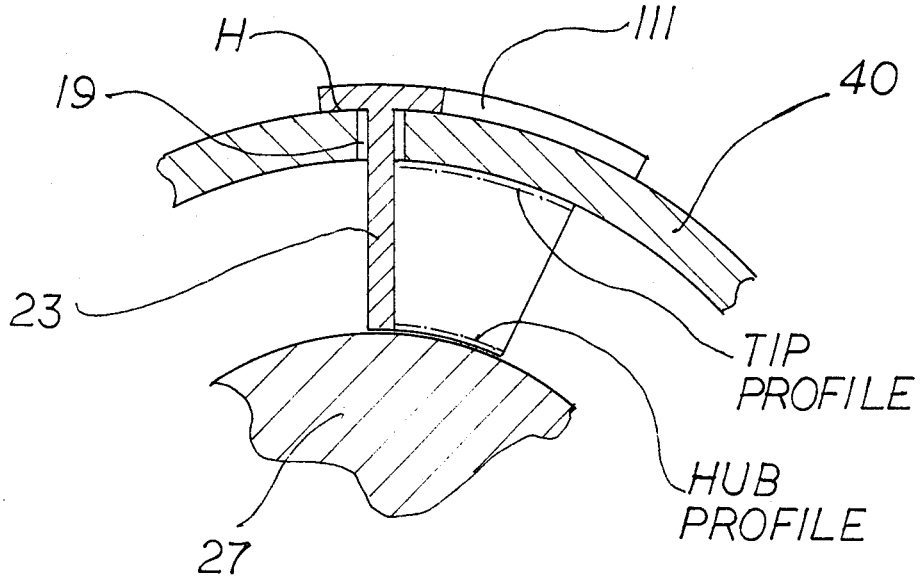
FIG. 11

INLET GUIDE VANE ASSEMBLY

BACKGROUND OF THE INVENTION

This invention relates to the pumps and compressors which incorporate adjustable inlet guide vanes for purpose of directing the fluid flow into the pump or the compressor rotating impeller.

Rotating fluid pumps and compressors are normally designed to operate best at specific fluid flow rate, pressure rise and rotating speed conditions. Process fluid flow systems often demand changes in the fluid flow rate, while maintaining relatively constant pressure rise. Such applications, very often employ pumps or compressors, operating at substantially constant rotating speed and include fluid flow control systems which bypass the excess fluid flow back to the pump or the compressor inlet by throttling of such fluid flow. Other control systems may utilize throttling of the entire pump flow, without the flow bypass. In such cases, a decrease in the fluid flow rate entering the pump or the compressor impeller causes a decrease in the axial fluid velocity while the rotational velocity of the impeller blades remain substantially constant. Such a condition causes higher relative inlet flow angle with respect to impeller blades, contributing to increase of blade inlet losses which negatively affect the pump efficiency and can produce unstable flow through the pump. Inlet guide vanes, producing pre rotation of the fluid flow in the direction of the impeller rotation, will decrease such high relative inlet flow angle, thus decreasing the blade inlet losses and increasing the impeller efficiency at such low flow conditions. Other applications, such as rotating air compressors used with turbochargers, boosting the pressure of internal combustion engines, are normally designed to achieve peak efficiency under pre-determined operating conditions. Change in the output power and rotating speed of internal combustion engine usually requires a cooresponding changes of charge air flow rate and the boost pressure delivered by the turbocharger to the engine. Such changes may result a decrease in the charge air flow rate, while the boost pressure demand remains disproportionally high. For instance, a reduction in the engine speed under high load conditions, usually decreases the ratio of the inlet air flow velocity relative to the rotatinal velocity of the turbocharger compressor blades, thereby producing higher inlet flow angle with respect to compressor impeller blades. Carefull matching of the turbocharger design to the specific engine requirements is needed, in order to avoid unstable compressor flows at such low flow conditions. Inlet guide vanes, causing pre-rotation of the air flow in the direction of the compressor rotation will, under such conditions, decrease the flow angle between the impeller blades and the air flow, thus allowing the turbocharger to achieve lower flow rates and increase its usefull flow range, while maintaining efficient compressor inlet flow conditions. Additionally, a fast responce of the inlet guide vanes system, when needed, during the engine and turbocharger acceleration, would be benefitial to the overall engine performance.

The use of inlet guide vanes in pumps and compressors to reduce the inlet flow angle for operating at conditions other than optimum is well known to the art. U.S. Pat No. 3,861,823 to George K. Serovy illustrates the use of inlet guide vanes,which are radially retractable in a linear fashion and which include automatic control system external to the fluid compressor. Such a control system, being connected to a system of ring gear, multiple pinion gears and rack members, inserts and retracts the guide vanes relative to the fluid flow.

Bladed turbine pump with adjustable guide vanes, in which the inlet guide vanes are linked to the second set of vanes located in the pump outlet, is described in the U.S. Pat. No. 4,484,857 to Pierre Patin. Such inlet guide vanes,being lengthwise pivotable, are continously submerged in the flow.

These approaches, while providing the desired inlet flow angle at part flow or at some other less than optimum conditions, use mechanical actuation systems, often employing ring gear, pinion gears, rack gears and levers. In order to maintain precise guide vanes alignment, such systems usually require a high degree of precision and minimum internal clearances between the mating parts, while at the same time allowing for manufacturing tolerances and thermal expansion differences that may occur in operation. Such mechanisms usually have relatively low tolerance toward particulate contamination between such mating parts. Repetitive cycling of such systems, with inlet guide vanes being subject to a great deal of turbulence generated by relatively high fluid velocities, tend to induce chatter and vibration into the guide vanes systems, which may lead to premature wear and malfunction of moving parts. Actuation systems, having multiple internal clearances in series, and which are required to transmit reversable motions, may also lag in responce when required to produce rapid and precise change of the inlet flow direction. Therefore, it would be desirable for such system to have a minimum mass inertia and no mechanical clearances between the individual parts.

It would be also desirable, for such guide vanes system, to be relatively insensitive to a particulate contamination in the fluid flow, with respect to its functional performance.

SUMMARY OF THE INVENTION

It is an object of this invention to provide, a guide vane assembly which guide the fluid flow in a desired direction only when required and to have a minimum interference with the fluid flow when not in use.

It is further object of this invention to provide a guide vane assembly which utilizes pump discharge pressure, acting on a single coaxial annular piston, to directly adjust the position of such inlet guide vanes, by pivoting said guide vanes into and out of the fluid flow.

It is still further object of this invention to provide a guide vane assembly which utilizes automatic control means to adjust the position of inlet guide vanes, to properly improve the inlet flow angle of the fluid under conditions other than the optimum design conditions.

It is still further object of this invention to provide a guide vane assembly which, while fulfilling the above objects, utilizes continous mechanical loading of such guide vanes, to maintain zero clearances between the actuation piston and the pivoting guide vanes.

It is still further object of this invention to provide a guide vane assembly which, while fulfilling the above objects, is simple and efficient in design.

An inlet guide vane assembly for a pump or a compressor having rotary blades is provided. The guide vanes of the assembly are pivotably disposed in a housing defining an fluid flow passageway so that a portion of the vanes can be inserted into or withdrawn from the passageway by pivoting the guide vanes about a pivot axis. Control means is provided for controling the degree of pivot.

BRIEF DESCRIPTION OF THE DRAWINGS

These and other objects of the invention will become apparent from a study of the following specifications and drawings, in which:

FIG. 8 is a sectional view of a alternate automatic control means.

FIG. 9 is a diagram representing pressure rise as a function of flow, of a typical centrifugal pump and representing also the operating points of the alternate control means shown in FIG. 8.

FIG. 10 is a view of typical inlet guide vane sealing plate.

FIG. 11 is a sectional view taken along the line 11—11 of FIG. 10.

DESCRIPTION OF THE PREFERRED EMBODIMENT

Figure 1:
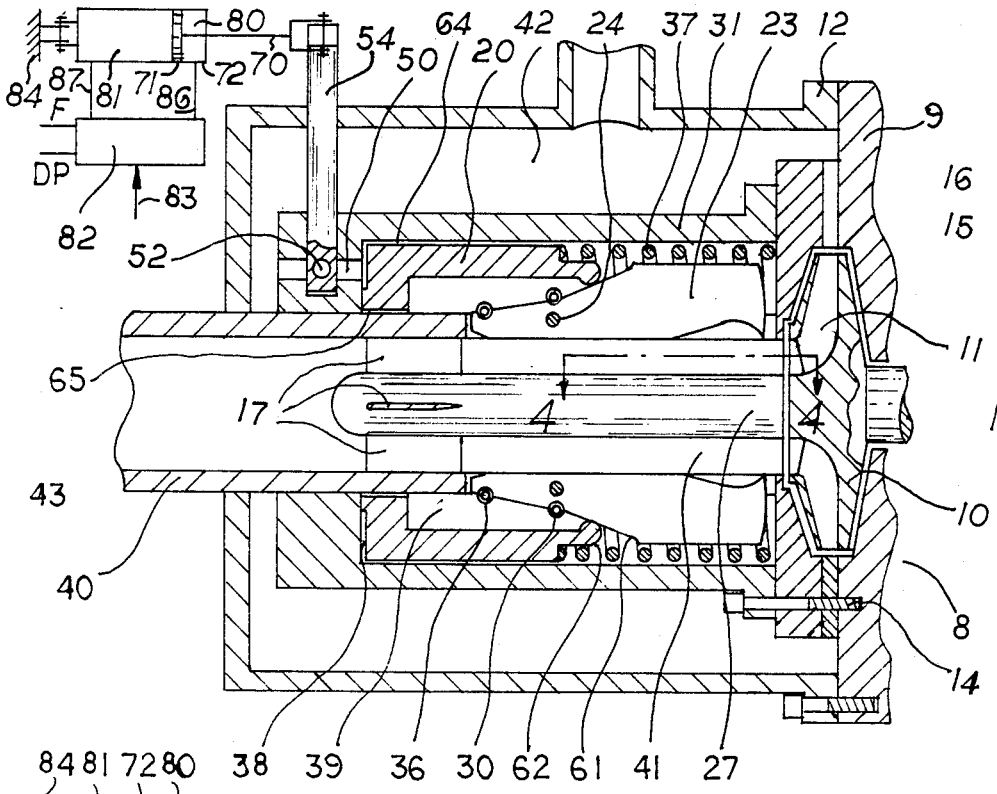
FIG. 1 is a sectional elevation of the pump incorporating the invention, with the guide vanes removed from the fluid flow.

With particular reference to FIGS. 1, 2, 3, 4 and 5, a pump incorporating the principles of the present invention is generally indicated by the reference numeral 8. Such pump 8 includes blades 11 being a part of the bladed impeller 10, which is rotatably mounted to the housing 9 and is further contained within pump housing 12. The central body 27 is fixed by stationary vanes 17 to inlet pipe 40 which provides the base for a plurality of bearing grooves 25 supporting the pivot axis 24 which are rigidly connected to the inlet guide vanes 23. The inlet pipe 40 together with the piston housing 31 are rigidly connected to the housing 9 with bolts 14. As shown on FIG. 5, the inlet guide vanes are configured as flat surfaces at the flow enterance and are curved at the trailing edges to a desired angle indicated by the letter A. Such angle A may vary along the radial lenght of the vanes 23 for a purpose which will be explained later. The relative position of individual vanes 23 is such, as to form together with the central body 27 and the inlet pipe 40, a series of efficient flow turning passages when the vanes are fully inserted into the fluid flow. The inlet pipe 40 includes radial slots 19, allowing the guide vanes 23 to pivot freely about the pivot axes 24, while being guided by the radial slots 19 in peripheral and axial directions, said slots 19 being configured in close proximity to the guide vanes 23, thus preventing excessive side-movement of such vanes, and at the same time preventing excessive fluid flow exchange between annular flow passage 41 and the cavities 38 and 39. A elastic band 30, being expanded peripherally over the ridges formed by guide vanes 23, and located substantially over the pivot centres formed by the guide vane pivot axes 24 and groves 25, is loading said guide vanes in a inward direction, thus resulting in a continous contact between pivot axes 24 and groves 25. A elastic band 36, being expanded peripherally over the ridges formed by the guide vanes and located substantially of center relative to pivot axes 24, is loading said guide vanes in a way to affect said guide vanes to pivot in the direction of retracting said guide vanes from the fluid flow. For reasons which will be described further on, the annular ridge 62, being a portion of the annular piston 20 is at all times in a sliding contact relationship with the guide vanes ridges 61 thus counterbalancing the moment causing by the action of said elastic band 36. The position of the guide vanes 23 is therefore, directly governed by the axial position of the annular piston 20, which is movable in axial direction, while compressing the spring 37 to a degree proportional to its axial motion.

A valve stem 54, configured with the flow passage 52 is rotatably mounted in the piston housing 31 and pump housing 12. By rotating the valve stem 54, the valve passage 52 can align to a varying degree with the passage 50 configured in the piston housing 31, thus selectively opening or closing said passages. Since the highest fluid pressure is in the pump discharge cavity 42, the change in the flow area of the valve 52, will pressurize to a varying degree cavity 38, thus directly affecting the pressure differential across the piston 20. The fluid pressure in the cavity 39 is nearly equal to the pressure in the annular passage 41 due to close communication of cavity 39 and the passage 41 through the slots 19, thus causing the pressure in the cavity 39 to be nearly the same as the pump inlet pressure. As shown on FIG. 1, the valve passage 52 is in a position of preventing fluid communication between the pump discharge cavity 42 and the cavity 38. Due to the annular gaps 64 and 65, between the piston 20 and piston housing 31 and the inlet pipe 40, the fluid pressure around the piston 20 is substantially equalized. Since the free length of the spring 37 is longer than the maximum allowable space, the force generated by the spring 37 holds the piston 20 in a solid contact with the piston housing 31, thus allowing the guide vanes to be fully retracted from the annular passage 41, by the action of elastic band 36. The force caused by the compression of spring 37, being linearly proportional to the axial displacement of said spring,is being counterbalanced by a fluid pressure difference between cavities 38 and 39. As described earlier, the valve passage 52 can prevent direct fluid communication between pump discharge cavity 42 and cavity 38 such as shown on FIG. 1, or it can be positioned to be aligned with the passage 50 as shown in the FIG. 2, allowing for direct and relatively unobstructed fluid flow communication between the cavities 42 and 38, in which case, the cavity 38 is being pressurized to a value higher than the cavity 39. The resulting pressure difference between the cavity 38 and cavity 39 is being counterbalanced by the force of the compressed spring 37 and by the axial component of the force acting on the countour 62 of the piston 20, due to the contact with the contour 61 of the guide vanes 23. A fluid flow relationship between the degree of opening of the valve passage 52 and the pressure in the cavity 38, is affected by the pressures in the cavity 42 and the inlet annulus 40, and by the fluid leakage through the gaps 64 and 65. By a suitable design choice of springs 37 and 36, shape of the guide vane ridge countour 61, frontal area of piston 20, size of gaps 64 and 65, and the flow area of the valve 52 with relation to the pump differential pressure, a desired balance can be achieved between the fluid and the spring forces, at all guide vanes postions, ranging from fully retracted position as shown in FIG. 1, to fully inserted position as shown on FIG. 2.

Figure 4:
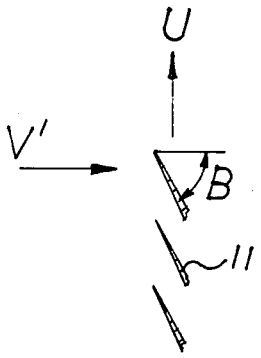
FIG. 4 is a developed sectional view taken along the line 4—4 of FIG. 1.

For the purpose of illustrating the operation of the present invention at optimum design conditions, FIG. 4, representing a section indicated by a broken line 4—4 on FIG. 1, shows the angle B of the impeller blades inlet edges and its relation to said blades tangential velocity U and the axial fluid inlet velocity V'.

Figure 6:
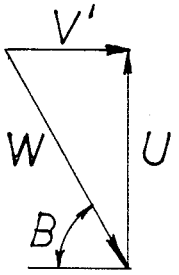
FIG. 6 is a vector diagram representing the fluid flow and the impeller blades velocities and relative flow angles, with the guide vanes removed from the fluid flow.

FIG. 6 shows a conventional vector diagram of typical velocities associated with FIG. 4. To those skilled in the art, it becomes obvious from the vector diagram, that under such optimum conditions, the inlet flow velocity into the impeller blades, as represented by vector V', is in a purely axial direction. Said vector V', when compounded with the blades tangential velocity vector U, results in a relative velocity vector W, positioned at angle B relative to the axis of the blades rotation. Said angle B, being identical to the blades inlet angle B shown on FIG. 4, indicates the the relative flow vector is aligned with the blades, under said optimum flow conditions.

Figure 2:
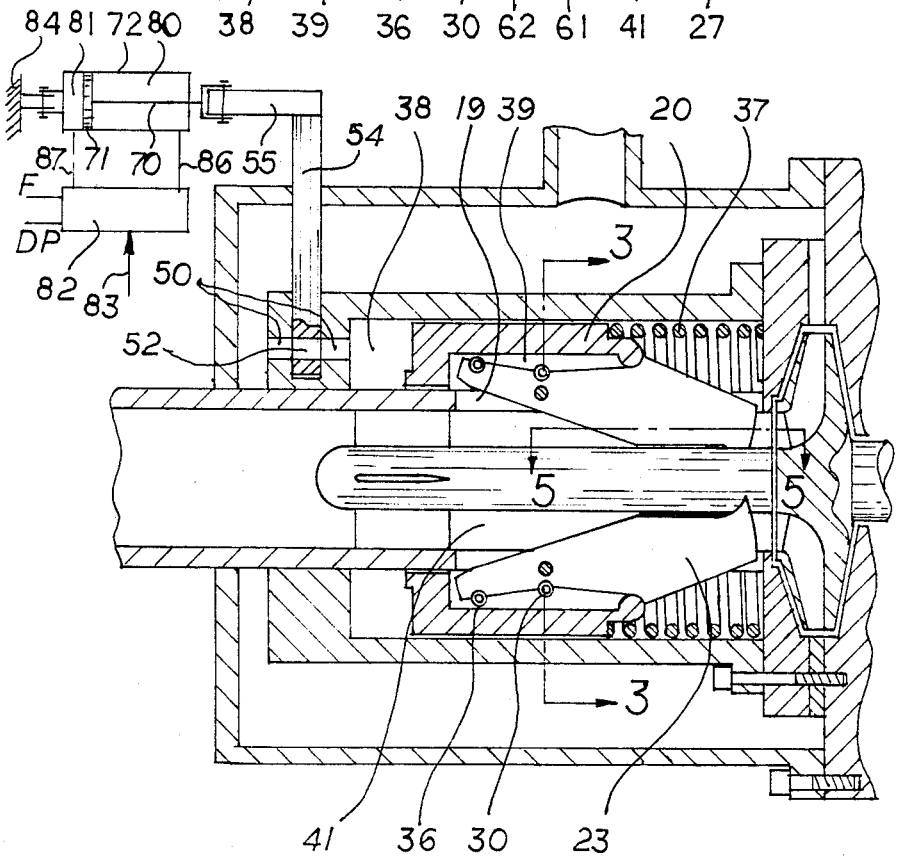
FIG. 2 is a sectional elevation of the pump incorporating the invention, with the guide vanes fully inserted into the fluid flow.
Figure 3:
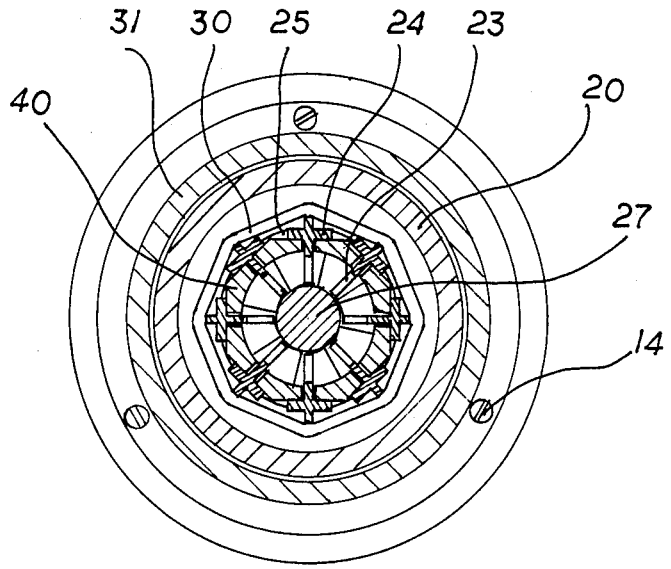
FIG. 3 is a sectional view taken along the line 3—3 of FIG. 2.
Figure 5:
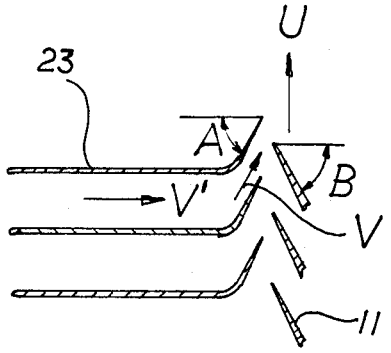
FIG. 5 is a developed sectional view taken along the line 5—5 of FIG. 2.
Figure 7:
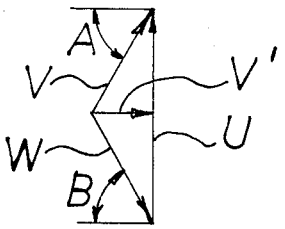
FIG. 7 is a vector diagram representing the fluid flow and the impeller blades velocities and relative flow angles, with the guide vanes fully inserted in the fluid flow.

FIG. 5 shows a sectional view of the inlet guide vanes being fully inserted into the inlet flow, as indicated by the broken line 5—5 shown on FIG. 2. FIG. 7 shows a typical vector diagram associated with flow conditions shown on FIG. 5, where there was a substantial decrease in fluid flow rate as compared to the previously described optimum flow condition. The axial inlet flow velocity, being substantially lower than that at the optimum flow conditions, is being represented by the vector V', while at the same time the blades rotational velocity as represented by the tangential velocity vector U, has remained substantially constant. As it will be described later, such a low flow condition has called upon insertion of guide vanes 23, resulting in a change in the inlet flow direction, from purely axial to a flow rotated to a angle A relative to the axis, with the absolute inlet flow velocity represented bu the vector V. To those skilled in the art, it becomes obvious that such flow prerotation under certain low flow conditions and when the guide vanes inlet angles are designed properly, will result in the angle B, between the relative velocity vector W and the rotating axis direction shown on FIG. 7, to coincide with the blades inlet angle B as shown on FIG. 5, thus providing for a incidence angle free, improved inlet flow conditions.

Due to variation of the impeller blades tangential velocity along the impeller blades radius, the guide vanes 23, as shown on FIGS. 10 and 11, may be configured to generally provide less turning at the lower radial distance from the impeller center, indicated as hub profile on FIGS. 10 and 11, and more turning at the larger radial distance, indicated as tip profile on FIGS. 10 and 11, in order to match more properly the angle B of the relative velocity W with the generally varying blades angle B, along said blade radius. Due to a twist along the radial dimension, of the trailing edge of the guide vanes profile, shown as a difference between tip profile and the hub profile on FIG. 10, and considering that slot 19 must accomodate pivoting motion of said guide vanes, said slot 19 is enlarged in the area of said profile twist, and such enlargement indicated as extended slot 19 on FIG. 10. Since fluid flowing through turning vanes generally produces a pressure differential across the vane profiles, a sealing plate has been incorporated into the overall guide vane shape and shown as portion of the guide vane 23, such sealing plate being identified by a numeral 111 on FIGS. 10 and 11. Said sealing plate 111 contour is designed to fit a matching surface of the inlet pipe 40, so as to form a sealing surface indicated by a letter H on FIG. 11, thus preventing reciruclation of fluid in and out of the annular inlet passage 41 through said extended slot 19 area.

The principal control elements are shown schematically in FIGS. 1 and 2. A hydraulic cylinder 72 is anchored at one end to a pump or a compressor frame 84. Said hydraulic cylinder 72 includes piston 71 which is attached to a arm 55 of the valve stem 54 by a control rod 70. A control unit 82, interposes the cylinder 72 and the fluid source 83, receives an input signal such as pump discharge pressure or flow, designated by arrows DP and F, respectively. In response to the input signal, the control unit modulates the flow from the supply source to the hydraulic cylinder 72 by way of conduits 86 and 87, communicating respectively with internal chambers 80 and 81 located within cylinder 72.

Pump or the compressor performance may be easily measured by sensing the flow or the discharge pressure signals, which may be transmitted as a fluid pressure or as electrical signals to the control unit 82. For example, a decrease in the pump flow, transmitting such signal to the control unit 82, will cause the hydraulic fluid to enter the chamber 80 and proportinally to discharge the hydraulic fluid from the chamber 81, causing the piston 71 and control rod 70 to move arm 55 and rotate the valve stem 54, causing the passages 50 and 52 to open, allowing the pump discharge pressure to cause the fluid flow from cavity 40 to the cavity 38, causing the piston 20 to compress spring 37 and cause insertion of the guide vanes into the inlet flow annulus 41. A simmilar effect may be accomplished in principle by utilizing the discharge pressure signal or both signals, where the control unit is preprogrammed to compute the proper response of the hydraulic system acutating the piston 71.

A alternate guide vanes control system shown in FIG. 8, utilizes variation of the pump discharge pressure in the cavity 42, to cause a move of the inlet guide vanes 23 from a fully withdrawn position to a fully inserted position and vice versa. Control elements shown in FIG. 8 consist of a fluid cylinder 90 which includes an elongated piston 92 with stepped diameters, resulting a piston areas C, D and E, spring 93 and retaining screw 94. The fluid cylinder 90, together with the passages 97, 96 and 95 are configured within the body of the annular housing 91, which also houses the annular piston 20. The housing 91 is configured in the same fashion as the housing 31 shown in FIG. 1, 2 and 3, except for the details pertaining to the passages 52, 51 and the valve stem 54 which have been replaced by a alternate control system shown in the FIG. 8. All other features omitted on the FIG. 8 are the same as those shown on FIGS. 1, 2, 3, 4, 5, 6 and 7.

With the reference to FIG. 8, a piston 92 has a intermediate step, limiting its axial motion caused by a compressed spring 93 to a position shown by a broken line, whereas in this position, the largest diameter of the piston does not cover the passage 97, which allows fluid flow communication between the pump discharge cavity 42 and the cylinder chamber 98. Obviously, said position can be only achieved when the force generated by spring 93 is higher than the opposing difference in fluid pressures acting on piston 92, which right hand side is subject to a pump discharge pressure acting on the annular area D transmitted from cavity 42 via passage 97 into a cylinder chamber 98, plus the pressure acting on the area E transmitted from the cavity 38, which is nearly equalized with the annular inlet passage 41. The left hand side of the piston 92 is subject to the pump inlet pressure transmitted into chamber 99 via passages 88 and 89 from the pump inlet passage 43.

In said position, indicated by a broken line, the smallest piston diameter section is fully inserted into the passage 95, thus substantially blocking a flow communication between the pump discharge cavity 42 and the annular piston cavity 38, with the resulting pressure in the cavity 38 to be nearly equal to pressure in the annular inlet passage 41. As it has been explained earlier, under similar conditions, said pressures are nearly equal due to said cavity and the said passage close communication through the slots 19 and gaps 64 and 65. The inlet guide vanes, under such pressure conditions in the cavity 38 are fully withdrawn from the annular passage 41.

The pressure rise - flow relationship of a typical turbopump operating at constant rotating speed, is represented in FIG. 9 by a curve J for the inlet guide vanes fully withdrawn from the inlet flow passage, and by a curve K for said vanes fully inserted into the said flow passage. The nominal operating point assumes the pump operation to be with guide vanes fully withdrawn, and is for example indicated by a letter N. Typically, in the fluid flow systems utilizing discharge throttling to control the fluid flow, as the flow decreases, the pressure rise increases, thus for a pump operating nominally at the point N the pressure rise would be increasing from a value indicated by a letter Pn, toward the point O having the pressure rise value Po. At said point N, the balance between the force of the spring 93 and the force resulting from fluid pressures acting on stepped piston 92, areas C, D and E, is such, that said stepped piston smallest diameter is fully inserted into cavity 95 as indicated by a broken line. As the flow decreases and the pressure rise increases, and assuming for example, that the pump inlet pressure and the pressure in the chamber 99 remains relatively constant, the pressure in the cavities 42, passage 97 and chamber 98 increases, thus increasing the pressure difference across piston 92 in the direction of increasing the load on spring 93. By a suitable design choice of spring 93 and said spring preloading by a adjustable screw 94, and as the forces due to said pressure diference increase toward the value Po, repsented by the point O on FIG. 9, the spring 93 begins to compress, allowing the piston 92 to move leftwardly. As soon, as the right hand edge of piston 92 facing the cavity 38, begins to open the passage 96, the pressure in the cavity 38 begins to increase due to the fluid flow from the cavity 42 into the cavity 38, thus increasing the fluid pressure against the surface area E of the piston 92, which action causes still larger unballance force compressing the spring 93 even more, thus opening the passage 96 still further, which increases the fluid pressure in the cavity 38 still closer to the pump discharge pressure in the cavity 42, until the piston 92 is in the most leftward position. At this point, the passage 96 is fully open and the motion of the piston 92 is stoped by a extention of the screw 94. The force balance in this position of piston 92 is such, that the excess of fluid forces acting on areas C, D and E, against the spring 93, is being reacted by the extention of the screw 94. With passage 96 fully open, the cavity 38 is pressurized by the pump discharge pressure and the inlet guide vanes 23 are fully inserted. The pump operating point has been shifted from point O on the curve J to a point R on the curve K, indicating a substantial decrease in fluid flow caused by fluid dynamic action of fully inserted guide vanes, as it has been explained earlier using FIGS. 4, 5, 6 and 7. The most leftward position of piston 92 is being maintained as long as there is a force being reacted between the piston 92 and the extention of screw 94. As the pressure rise of the pump decreases from a value Pr toward a value Ps, as indicated on FIG. 9, the pressure forces acting on areas E and D decrease, and the excess force balancing the difference between the fluid forces and the force due to spring 93, that is being reacted by the extention of the screw 94, also decreases. At the point when the fluid forces acting on the piston 92 become lower than the force of the compressed spring 93, the piston 92 begins to move toward its rightward position, beginning to close the passage 96, thus generating a fluid flow restriction between cavities 42 and 38 and decreasing the fluid pressure in cavity 38, causing further decrease of pressure acting on the piston area E, thus causing a further force unbalance, moving the piston 92 further to the right, blocking the passage 96 more and decreasing the pressure acting on the area E still more, until the passage 96 is blocked and the pressure in the cavity 38 is nearly equalized to the pressure in the pump inlet passage 41 via slots 19 and piston gaps 64 and 65, causing the piston 92 to move into its most right position and causing the annular piston 20 to move into its most left position, thus causing the inlet guide vanes to retract from the fluid flow. At this point the pump operation has shifted from point S on curve K, to the point N on curve J. By a suitable design of the piston areas C, D and E, length of the piston travel, location of passage 96, the spring 93 and its preload, passage sizes and other parameters, a choice can be made relative to the specific pump characteristics as generally represented by curves J and K, of the points at which the guide vanes are to be inserted and retracted.

From the foregoing it will be appreciated that the present invention provides novel and improved inlet guide vane system. While a preffered embodiment of the invention is described and illustrated herein, there is no intent to limit the invention to this or any particular embodiment.

What is claimed is:

1. An inlet guide vane assembly for a pump or a compressor having rotary blades comprising:

a housing means defining an passageway for providing a fluid passageway to said rotary blades, a plurality of guide vanes, each of said guide vanes being pivotably disposed in said housing means so that by pivoting said vane about a pivot axis said guide vane may be inserted into or removed from said passageway, the extent of such insertion being determined by the degree of pivot of said vane about said axis, a control means to control the degree of pivot of said guide vanes wherein the passageway defined by said housing is an annular passageway, wherein said control means comprises an annular piston disposed in said housing means so that axial movement of said piston will apply a force on said plurality of guide vanes causing pivotal movement of said plurality of guide vanes, wherein said control means further comprises a pressure means for applying a pressure differential across said annular piston to cause said piston to move axially, wherein said control means further comprises a counteracting force means to apply forces counteracting forces exerted by said pressure means, wherein said pressure means further comprises a fluid flow passageway means permitting fluid passage from the discharge of said pump or a compressor to said annular piston such that the pressure of said discharge is utilized to apply the pressure differential across said piston, wherein said pressure means further comprises a control valve disposed in said fluid fow passage means and the configuration of said piston in said housing means is such as to permit fluid leakage past such piston so that the pressure on said piston can be controlled by adjustments of said control valve.

2. The assembly of claim 1 wherein said pressure means further comprises an automatic control means for automatically adjusting said control valve.

3. The assembly of claim 1 and further comprising a first elastic means for applying to said plurality of guide vanes a radial force at their pivot axis to assure continous contact of said vane to said housing at the pivot axis.

4. The assembly of claim 1 and further comprising a second elastic means for applying a radial force to said plurality of guide vanes to counteract the force applied to said plurality of guide vanes by said piston.

5. The assembly of claim 1 wherein the inserted portion of said guide vanes are configured with straight surfaces and curved surfaces said curved surfaces being downstream in said annular fluid passageway from said straight surfaces.

6. The assembly of claim 1 wherein said pivot axes are located radially outside said annular passageway.

7. The assembly of claim 1 wherein said pivot axes are located radially inside said annular passageway.

8. The assembly of claim 6 wherein said pressure means also comprises a stepwise pressure control means for increasing or decreasing the pressure differential across said annular piston in a stepwise manner.

9. The assembly of claim 1 wherein the stepwise pressure control means is automatic in response to an increase or decrease in the discharge pressure of said pump or a compressor.

10. The assembly of claim 1 wherein said guide vane comprises sealing means for reducing leakage around said vanes when said vanes are fully inserted into said fluid passageways.

* * * * *